United States Patent [19]

Roden

[11] Patent Number: 4,940,082

[45] Date of Patent: Jul. 10, 1990

[54] CLEANING SYSTEM

[75] Inventor: James R. Roden, Phoenix, Ariz.

[73] Assignee: Professional Chemicals Corporation, Chandler, Ariz.

[21] Appl. No.: 286,616

[22] Filed: Dec. 19, 1988

[51] Int. Cl.[5] ..... A47L 7/00; A47L 5/12; A47L 11/34; F25B 29/00

[52] U.S. Cl. ..... 15/321; 15/320; 68/18 R; 239/129; 239/130; 237/2 B; 62/323.1; 62/238.6; 165/41; 165/51

[58] Field of Search ..... 165/41, 51; 237/2 B; 239/129, 130; 15/320, 321; 134/108; 68/18 R, 18 C; 62/323.1, 238.6

[56] References Cited

U.S. PATENT DOCUMENTS

| | | | |
|---|---|---|---|
| 2,586,569 | 2/1952 | Sedgwick | 68/18 C |
| 3,594,849 | 7/1971 | Coshow | 15/321 |
| 3,775,053 | 11/1973 | Wisdom | 68/18 C |
| 4,109,340 | 8/1978 | Bates | 165/51 |
| 4,158,248 | 6/1979 | Palmer | 15/321 |
| 4,207,649 | 6/1980 | Bates | 15/321 |
| 4,284,127 | 8/1981 | Collier et al. | 15/321 |
| 4,336,627 | 6/1982 | Bascus | 15/321 |
| 4,443,909 | 4/1984 | Cameron | 165/51 |
| 4,593,753 | 6/1986 | McConnell | 165/51 |

FOREIGN PATENT DOCUMENTS

| | | | |
|---|---|---|---|
| 2116301 | 9/1983 | United Kingdom | 62/238.6 |

*Primary Examiner*—John Ford

*Attorney, Agent, or Firm*—Cahill, Sutton & Thomas

[57] ABSTRACT

A cleaning system includes a liquid heating system utilizing heat from the cooling air and the exhaust gases of an internal combustion engine. A heat pump driven by the engine is utilized to extract heat from the cooling air and impart that heat to a first heat exchanger. A second heat exchanger is associated with the exhaust gases for extracting heat therefrom. Liquid to be heated is conveyed through said first and second heat exchangers.

4 Claims, 1 Drawing Sheet

CLEANING SYSTEM

TECHNICAL FIELD

This invention is concerned with liquid heating systems, particularly those suitable for heating cleaning liquid in portable cleaning systems.

BACKGROUND ART

A variety of services are available today for in-house cleaning of carpets and upholstery. These services utilize equipment for heating cleaning liquid which is conveyed under pressure to and sprayed onto the surface to be cleaned and then vacuum removed from the surface with the soil. This equipment, which often includes an internal combustion engine for driving the cleaning liquid and vacuum pumps, is usually mounted in a panel truck, or van, for ease of transport.

It has been suggested that instead of using a separate heater for heating the cleaning liquid that waste heat from the internal combustion engine be used for that purpose. U.S. Pat. No. 4,109,340 granted Aug. 29, 1978 to L. E. Bates for "TRUCK MOUNTED CARPET CLEANING MACHINE" discloses a system in which the cleaning liquid is passed first through the cylinder block of a liquid cooled, internal combustion engine and then through a heat exchanger which also has engine exhaust gases passing therethrough. U.S. Pat. No. 4,284,127 granted Aug. 18, 1981 to D. S. Collier et al for "CARPET CLEANING SYSTEMS" discloses a similar system which directs the cleaning liquid through a first heat exchanger into which the liquid engine coolant also is directed. The preheated cleaning liquid then passes through a second heat exchanger where it extracts heat from the engine exhaust gases.

Many portable cleaning systems in use today employ air cooled engines for driving the pumps because of the simplicity of that type engine compared to the liquid cooled engine. A disadvantage of air cooled engine systems is that the air used to cool the engine heats up the ambient air. And with the engine and associated apparatus confined within a panel truck, or van, the interior of the truck can become uncomfortably warm when the cleaning system is operated.

Of course, the temperature of the engine cooling air could be advantageously reduced by conveying that air and the cleaning liquid through a heat exchanger to transfer some of the heat in the air to the liquid. With a conventional heat exchanger there must be a significant differential between the temperature of the two fluids passing through the exchanger. Thus, if the cleaning liquid is to be heated to, say, 100° F., the temperature of the cooling air exiting the heat exchanger likely would be around 120° F. This air, then, continues to waste some heat and continues to produce uncomfortable conditions inside the truck.

DISCLOSURE OF THE INVENTION

This invention enables substantially all of the heat imparted to the cooling air by the engine to be removed from the cooling air and imparted to the cleaning liquid. More efficient heat utilization is achieved and the cooling air exiting the system can be at ambient temperature, say, 80° F., thereby maintaining comfortable conditions within the truck. All this is accomplished by employing a heat pump to extract heat from the cooling air and impart that heat to the cleaning liquid.

The heat pump comprises a compressor driven by the engine, a condenser associated with a heat exchanger through which the cleaning liquid flows, an expansion device, and an evaporator in heat exchange relationship with the cooling air flowing from the engine.

The invention further contemplates that the cleaning liquid, after being preheated with cooling air heat, be further heated by being placed in heat exchange relationship with the hot exhaust gases leaving the engine.

BRIEF DESCRIPTION OF THE DRAWINGS

The invention is described in greater detail hereinafter by reference to the accompanying drawings wherein.

BEST MODE FOR CARRYING OUT THE INVENTION

Figures 1, 2:
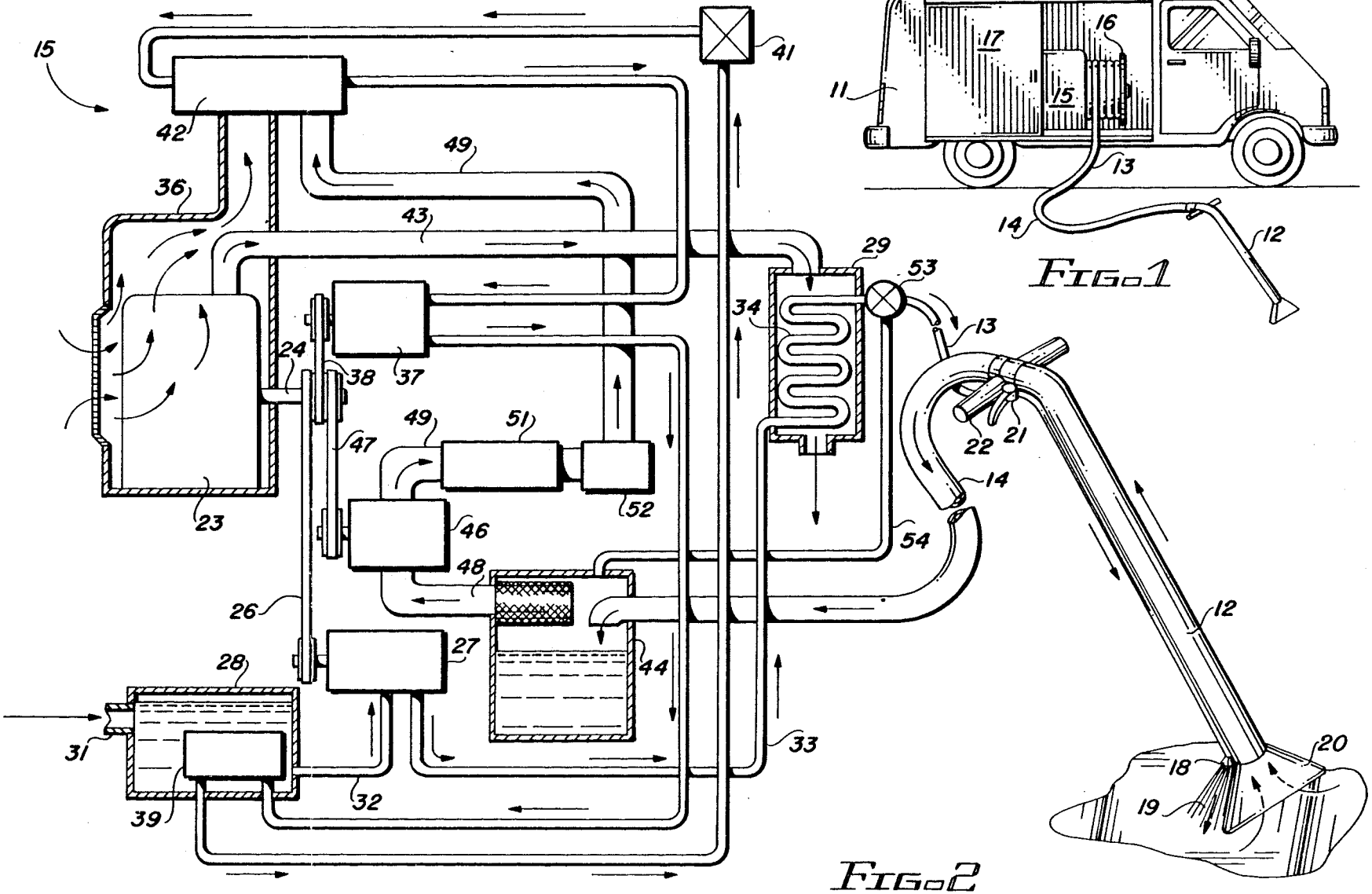
FIG. 1 is a side elevational view of a van equipped with a cleaning system embodying the invention.
FIG. 2 is a diagrammatic representation of the cleaning system

Illustrated in FIG. 1 is a portable carpet and fabric cleaning system of the type commonly in use today. The system comprises a panel truck, or van, 11, a cleaning wand 12 coupled by means of hoses 13 and 14 to a cleaning liquid supply and retrieval unit 15 housed in the truck. Hoses 13 and 14 may be stored on a reel 16. Truck 11 is provided with a door 17 to give access to the cleaning equipment.

Wand 12 is provided at its distal end with a spray nozzle 18 which has cleaning liquid 19 supplied thereto under pressure via high pressure hose 13 (see FIG. 2). The wand 12 further includes a vacuum nozzle 20 adjoining the area of the surface to be cleaned which is subjected to the spray of cleaning liquid 19 from spray nozzle 18. Vacuum nozzle 20 is in communication with vacuum hose 14.

In use, the wand 12 is drawn across the surface to be cleaned so that a progressive area of the surface is subjected to a spray of hot cleaning liquid from nozzle 18. The cleaning liquid imparted to the surface is thereafter vacuumed by nozzle 20 to remove most of the cleaning liquid and any loosened soil from the surface. The flow of cleaning liquid 19 to nozzle 18 is controlled by the operator by means of a hand manipulated valve 21 in pressure hose 13 near the wand handle 22.

The cleaning liquid 19 may vary depending upon the surface to be cleaned but usually comprises a detergent and surfactant admixed with water.

The components of the cleaning liquid supply and retrieval unit 15 are illustrated diagrammatically in FIG. 2. At the heart of this unit 15 is a multipurpose, air cooled, internal combustion engine 23. Energy to operate the engine 23 is supplied by any transportable fuel such as gasoline or propane.

One function performed by engine 23 is the pressurization and propelling of cleaning liquid through hose 13 to spray nozzle 18 on cleaning wand 12. To accomplish this the drive shaft 24 of engine 23 is connected by a belt drive 26 to a cleaning liquid pump 27. Pump 27 and associated piping constitute means for conveying cleaning liquid through first and second heat exchangers, designated 28 and 29 respectively, wherein the cleaning liquid is heated.

Cleaning liquid enters heat exchanger 28 via an inlet conduit 31 from a supply source (not shown). The cleaning liquid is withdrawn from heat exchanger 28 through a low pressure pipe 32 by pump 27 and is conveyed in a high pressure pipe 33 to a coil 34 within second heat exchanger 29. The heated cleaning liquid exits second heat exchanger 29 via high pressure hose 13 connected to cleaning wand 12.

The second function performed by internal combustion engine 23 is to supply waste heat energy to heat the cleaning liquid passing through heat exchangers 28 and 29. Two sources of heat energy from engine 23 are utilized; the first source is heat in the cooling air exiting the engine and the second source is the heat in the exhaust gases exiting the engine.

Internal combustion engine 23 is surrounded by a shroud 36 which functions as means for confining the cooling air passing over the engine and as means for conveying this cooling air away from the engine in a controlled manner.

Heat is extracted from cooling air passing through shroud 36 and imparted to cleaning liquid in the first heat exchanger 28 by means of a heat pump which is also driven by engine 23. The heat pump includes a compressor 37 which is driven by a belt drive 38 coupled to the drive shaft 24 of engine 23. The heat pump also includes a condenser 39 associated with the first heat exchanger 28, an expansion device 41 and an evaporator 42 associated with the shroud 36 conveying cooling air away from the engine 23.

The heat pump compressor 37, condenser 39, expansion device 41 and evaporator 42 are connected in a closed loop by tubing and charged with a suitable refrigerant, such as trichlorofluoromethane. In operation, gaseous refrigerant compressed by the compressor 37 is condensed in condenser 39 giving up its heat of condensation to cleaning liquid in heat exchanger 28. The liquid refrigerant next passes through expansion device 41 into a low pressure portion of the heat pump circuit which includes evaporator 42. The refrigerant absorbs heat from the engine cooling air as the latter passes over the evaporator. This causes evaporation of the refrigerant which is drawn into and compressed by the engine driven compressor 37. In this manner heat energy is transferred from the engine cooling air to the cleaning liquid passing through heat exchanger 28.

The principal advantage to employing a heat pump to extract heat from the engine cooling air is that this makes it possible to substantially reduce the temperature of exiting cooling air below the temperature to which the cleaning liquid is being heated in first heat exchanger 28. With a properly balanced system the engine cooling air can be reduced in temperature to ambient air temperature so that the cooling air does not heat up the interior of the truck 11 when the system is operated.

In a typical water heating operation with ambient air at 80° F., the hot cooling air conveyed away from engine 23 may be cooled by evaporator 42 back to 80° F. The heat thus extracted is released by condenser 39 into heat exchanger 28 to heat the cleaning liquid therein to around 140° F.

It is significant to note that any waste heat generated by engine 23 as a result of having to drive the compressor 37 of the heat pump is simply extracted from the cooling air and further used to heat the cleaning liquid.

As mentioned, the exhaust gases from engine 23 provide a second source of heat energy to further heat the cleaning liquid in heat exchanger 29 after the liquid has been preheated in heat exchanger 28. For this purpose the engine 23 is equipped with an exhaust pipe 43 which functions as means for conveying exhaust gases away from the engine. The exhaust pipe 43 is associated with and communicates with the interior of heat exchanger 29. Hot exhaust gases, which may be of the order of 600° F. to 1200° F. passing over coil 34 in heat exchanger 29 heat the cleaning liquid to a temperature of from 180° F. to 200° F. which is sufficiently hot to provide good cleaning action by the cleaning liquid. And all of the heating is provided without using any auxiliary heater such as the oil fired heater required in some cleaning systems.

The final function performed by internal combustion engine 23 is the creation of a vacuum to draw cleaning liquid, air and soil into the vacuum nozzle 20 on wand 12 and to convey the waste cleaning liquid and soil to a waste storage tank 44. Engine 23 drives a vacuum pump 46 through a belt drive 47 working off of drive shaft 24.

Vacuum pump 46 is in communication with the interior of waste tank 44 through pipe 48. The vacuum created within tank 44 draws the air/waste cleaning liquid/soil mixture through vacuum hose 14 into tank 44 where most of the cleaning liquid and soil separate from the air which is drawn into the vacuum pump 46.

The air expelled from vacuum pump 46 through discharge pipe 49 contains heat which can be employed in the cleaning water heating circuit. Much of this heat is imparted to the air during the period when the air is admixed with waste cleaning liquid in vacuum hose 14. Additional heat is imparted to the air when it is compressed in vacuum pump 46. By directing air discharge pipe 49 to the evaporator 42 of the heat pump the heat in the discharge air can be extracted by the evaporator and conveyed to the first heat exchanger 28 in the cleaning liquid heating circuit in the same manner as heat is extracted and delivered from the cooling air from the engine.

If desired, a muffler 51 and a liquid separator 52 may be interposed in discharge air pipe 49. The muffler 51 reduces emission of noise from vacuum pump 46. The separator 52 functions to recover any liquid remaining in the exhaust air to insure that it will not accumulate and possibly freeze on evaporator 42.

With the liquid supply and retrieval unit 15 operating as described above it is possible to overheat the cleaning liquid if the engine 23 is run for some considerable period of time with cleaning liquid flow control valve 21 closed. Liquid at a temperature in excess of 220° F. can damage some surfaces, so it is desirable to prevent the delivery of such high temperature liquid to cleaning wand 12. This is accomplished by a thermostatically controlled dump valve 53 in high pressure hose 13 at the exit of second heat exchanger 29. When valve 53 detects cleaning liquid temperature in excess of 220° F. it opens dumping the over heated cleaning liquid into waste tank 44 via pipe 54. Of course, when valve 53 detects that cleaning liquid at the exit from heat exchanger 29 has a temperature within the desired range it closes to stop the dumping of liquid.

From the foregoing it should be apparent that this invention provides an economical and reliable system for heating, delivering and retrieving cleaning liquid for carpet and fabric cleaning and other applications.

What is claimed is:

1. A cleaning system comprising in combination a liquid heating system comprising an air cooled internal combustion engine, means for conveying cooling air away from the engine, means for conveying exhaust gases away from the engine, first and second heat exchangers, means for conveying the liquid to be heated through said first and second heat exchangers, and a heat pump comprising a compressor driven by said engine, a condenser associated with said first heat exchanger, an expansion device and an evaporator associated with the means for conveying cooling air away from the engine, said second heat exchanger being associated with the means for conveying exhaust gases away from the engine, a spray nozzle operatively connected to the liquid conveying means to spray liquid heated by said first and second heat exchangers, a vacuum nozzle for retrieving liquid sprayed by said spray nozzle, a vacuum pump driven by said engine and connected to said vacuum nozzle for withdrawing liquid and air into said vacuum nozzle, and means for conveying air withdrawn into said vacuum nozzle to said heat pump evaporator.

2. A cleaning system comprising in combination a liquid heating system comprising an air cooled internal combustion engine, means for conveying cooling air away from the engine, means for conveying exhaust gases away from the engine, first and second heat exchangers, means for conveying the liquid to be heated through said first and second heat exchangers, a heat pump comprising a compressor driven by said engine, a condenser associated with said first heat exchanger, an expansion device and an evaporator associated with the means for conveying cooling air away from the engine, said second heat exchanger being associated with the means for conveying exhaust gases away from the engine, and a liquid pump driven by said engine, said pump causing the liquid to flow through said first and second heat exchangers, a spray nozzle operatively connected to said liquid conveying means to spray liquid heated by said first and second heat exchangers, a vacuum nozzle for retrieving liquid sprayed by said spray nozzle, a vacuum pump driven by said engine and connected to said vacuum nozzle for withdrawing liquid and air into said vacuum nozzle, and means for conveying air withdrawn into said vacuum nozzle to said heat pump evaporator.

3. A cleaning system comprising in combination a liquid heating system comprising an air cooled internal combustion engine, means for conveying cooling air away from the engine, means for conveying exhaust gases away from the engine, first and second heat exchangers, means for conveying the liquid to be heated through said first and second heat exchangers, and a heat pump comprising a compressor driven by said engine, a condenser associated with said first heat exchanger, an expansion device and an evaporator associated with the means for conveying cooling air away from the engine, said second heat exchanger being associated with the means for conveying exhaust gases away from the engine, a spray nozzle operatively connected to the liquid conveying means to spray liquid heated by said first and second heat exchangers, a vacuum nozzle for retrieving liquid sprayed by said spray nozzle, a vacuum pump driven by said engine and connected to said vacuum nozzle for withdrawing liquid and air into said vacuum nozzle, and means for separating the air from the liquid withdrawn into said vacuum nozzle and means for conveying that air to said heat pump evaporator.

4. A cleaning system comprising in combination a liquid heating system comprising an air cooled internal combustion engine, means for conveying cooling air away from the engine, means for conveying exhaust gases away from the engine, first and second heat exchangers, means for conveying the liquid to be heated through said first and second heat exchangers, a heat pump comprising a compressor driven by said engine, a condenser associated with said first heat exchanger, an expansion device and an evaporator associated with the means for conveying cooling air away from the engine, said second heat exchanger being associated with the means for conveying exhaust gases away from the engine, and a liquid pump driven by said engine, said pump causing the liquid to flow through said first and second heat exchangers, a spray nozzle operatively connected to said liquid conveying means to spray liquid heated by said first and second heat exchangers, a vacuum nozzle for retrieving liquid sprayed by said spray nozzle, a vacuum pump driven by said engine and connected to said vacuum nozzle for withdrawing liquid and air into said vacuum nozzle, and means for separating the air from the liquid withdrawn into said vacuum nozzle and means for conveying that air to said heat pump evaporator.

* * * * *